United States Patent [19]

Teagarden et al.

[11] 3,977,512

[45] Aug. 31, 1976

[54] RIBBON CASSETTE AND RIBBON ADVANCE

[75] Inventors: LeRoy O. Teagarden, San Leandro; Carmeli Adahan, Berkeley; William A. Ashmore, San Ramon, all of Calif.

[73] Assignee: The Singer Company, New York, N.Y.

[22] Filed: June 30, 1975

[21] Appl. No.: 591,367

[52] U.S. Cl. ..... 197/168; 197/151; 197/171; 226/162

[51] Int. Cl.[2] ..... B41J 33/10; B41J 33/30; B41J 35/28

[58] Field of Search..... 197/151, 168, 171, 153 R; 226/162

[56] References Cited

UNITED STATES PATENTS

| | | | |
|---|---|---|---|
| 3,283,876 | 11/1966 | Kern | 197/168 |
| 3,367,471 | 2/1968 | Berill | 197/153 R |
| 3,490,671 | 1/1970 | Hladky | 197/168 X |
| 3,621,968 | 11/1971 | Kondhr | 197/168 X |
| 3,726,212 | 4/1973 | Combs | 197/151 X |
| 3,726,381 | 4/1973 | Murphy | 197/168 |
| 3,758,012 | 9/1973 | Bonner et al. | 197/151 X |
| 3,762,530 | 10/1973 | Patel | 197/151 |
| 3,837,462 | 9/1974 | Patel et al. | 197/151 |
| 3,871,507 | 3/1975 | Perry et al. | 197/168 X |

FOREIGN PATENTS OR APPLICATIONS

| | | | |
|---|---|---|---|
| 12,870 | 7/1914 | United Kingdom | 197/168 |
| 29,235 | 5/1914 | United Kingdom | 197/168 |

OTHER PUBLICATIONS

L. P. Bernard, Print Mechanism Ribbon Feed, IBM Technical Disclosure Bulletin, vol. 7, No. 3, 8/64 p. 250.

Cross, Ribbon Drive, IBM Technical Disclosure Bulletin, vol. 15, No. 7, p. 2312, 12/1972.

Hingstman, Antifold Ribbon Guide Device, IBM Technical Disclosure Bulletin, vol. 17, No. 1, June 1974.

*Primary Examiner*—Edgar S. Burr
*Assistant Examiner*—William Pieprz
*Attorney, Agent, or Firm*—Charles R. Lewis; Edward L. Bell; Joseph R. Dwyer

[57] ABSTRACT

A cassette for a printer for supplying mobius loop ink ribbon to the print head which includes a means for inking the ribbon as it is returned to the cassette and a means for storing the ribbon by randomly stuffing the ribbon in convolutions therein. The cassette also includes a driving means located between the inking means and the storage means for storing the ribbon through the cassette as the print head traverses the record media. In the embodiment disclosed, this driving means includes a one-way clutch actuatable by means carried by the print head. An important aspect resides in the intallation of the cassette in the printer in that there is no direct interengaging of the driving means with the printer so that the position of the print head at the time of installation of the cassette is immaterial. The disclosure also includes new and improved pulley guides for the ribbon as it is being transported to and from the cassette.

5 Claims, 6 Drawing Figures

RECEIPT STATION
AUDIT TRAIL STATION
FORM STATION
10
12
14
28
120
122
124
126
128
130
132
134
136
138
140
142
144
146
148
152
154
156
158
160
2

RIBBON CASSETTE AND RIBBON ADVANCE

BACKGROUND OF THE INVENTION

This invention relates in general to printers utilizing a ribbon cassette for feeding an ink ribbon to the print head of the printer and in particular to a new and improved cassette for a printer which is particularly useful in point-of-sale transaction terminals utilizing a wire matrix type printer which traverses a plurality of print stations, although could be useful in any printer in which the print head traverses a record media for printing alphanumeric characters thereon.

While it is recognized that there are a number of ribbon cassettes for supplying inked ribbon to a print head in alphanumeric printers, such as typewriters, manual or automatic, and other types of printers, such as those used on point-of-sale terminals, one of the undesirable features of existing cassettes is the manner in which they cooperate with some type of mechanism which is coordinated with the print head for feeding the inked ribbon to the print head during use. The most common means is a set of gears on the printer which will engage or intermesh with a gear on the cassette so as to actuate the ribbon feed mechanism as the print head traverses the record media. So far as it is known, all existing cassettes have a positive intermeshing or interengaging direct contact relationship with a similar and corresponding mechanism on the printer itself. Such a direct contact relationship requires precise positioning of the cassette relative to its corresponding interengaging or intermeshing mechanism and if the positioning is not precise, it is often the cause of malfunction. That is to say, misalignment may cause a malfunction.

It is a first object of this invention, therefore, to provide a cassette which will cooperate with the print head of a printer in such a manner that the installation of the cassette on the printer does not require a precise relationship to the printer to function satisfactorily.

While it is also recognized in the prior art cassettes that a mobius loop has been used and that some prior art cassettes have been provided with means for inking the ribbon as it passes through the cassette, while still others have utilized the concept of a randomly packed endless ribbon, none of the prior art cassettes have recognized the advantage of providing a means of inking an endless mobius loop as the ribbon first enters the cassette and before it is randomly packed therein so that the ink can sufficiently migrate through the threads of the ribbon and at the same time afterwards be held in randomly packed inked condition ready for egress from the cassette. The advantage of this arrangement is, of course, a provision of an extremely long life to the ribbon, plus a ribbon that is well inked when it is before the print head.

Accordingly, it is still another object of this invention to provide a cassette with a means of inking a mobius loop ribbon as it passes through the cassette such that the ribbon has sufficient time when in engagement with inking means to have a good exchange of ink from the inking means to the ribbon.

Another object of this invention is to provide a simple, inexpensive ribbon cassette with a mobius loop ribbon which can supply a print head of a printer with a sufficiently inked ribbon over a long period of time.

Finally, still another object of this invention is the provision of a new and improved pulley in a printer for guiding the ink ribbon to and from the cassette, thus preventing malfunction of the ribbon and print head.

SUMMARY OF THE INVENTION

The foregoing objects of this invention are accomplished by providing a cassette with an incremental ribbon feed mechanism which is actuated by the print head simply as it traverses the record media. The ribbon incrementing means is simply an external latching arm which is engaged by the print head, or some object which corresponds with the movement of the print head, whose relationship to the print head on installation of the cassette is immaterial. That is to say, whatever the position of the print head, it is of no consequence on installation of the cassette since it is only during the operation of the print head that the ribbon incrementing means is actuated.

Another aspect of this invention is the cassette itself which cooperates with the print head and which comprises a relatively long flat cassette of a thickness sufficient to receive a ribbon and includes an ink supply for inking the ribbon as it returns to the cassette and a means for holding the ribbon randomly stuffed with the cassette.

BRIEF DESCRIPTION OF THE PREFERRED EMBODIMENT

Figure 1:
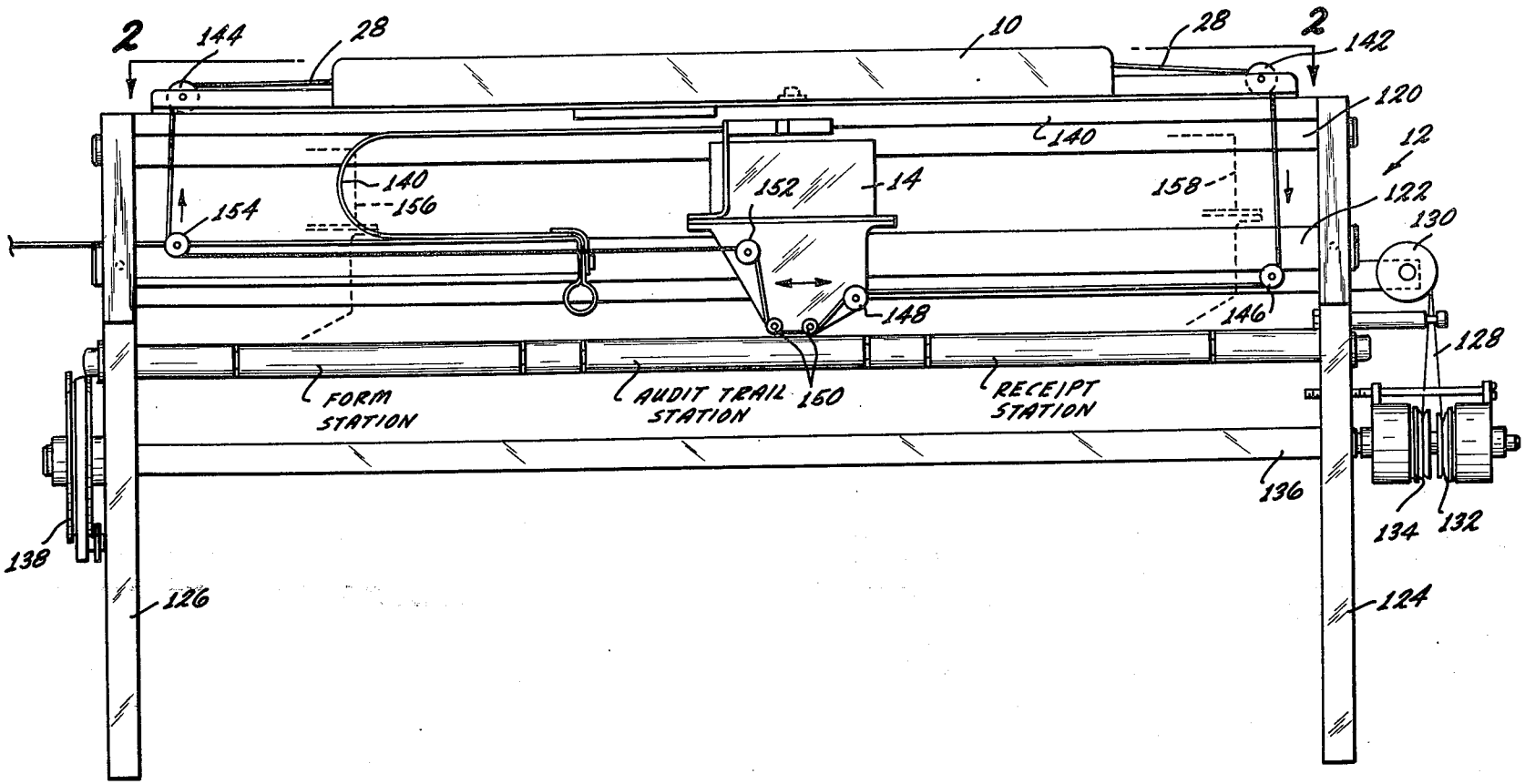
FIG. 1 is a schematic illustration of the printer in which the cassette is utilized which, in this case, is a schematic illustration of only a portion of a point-of-sale terminal with a single wire matrix print head traversing three print stations therein.
Figure 2:
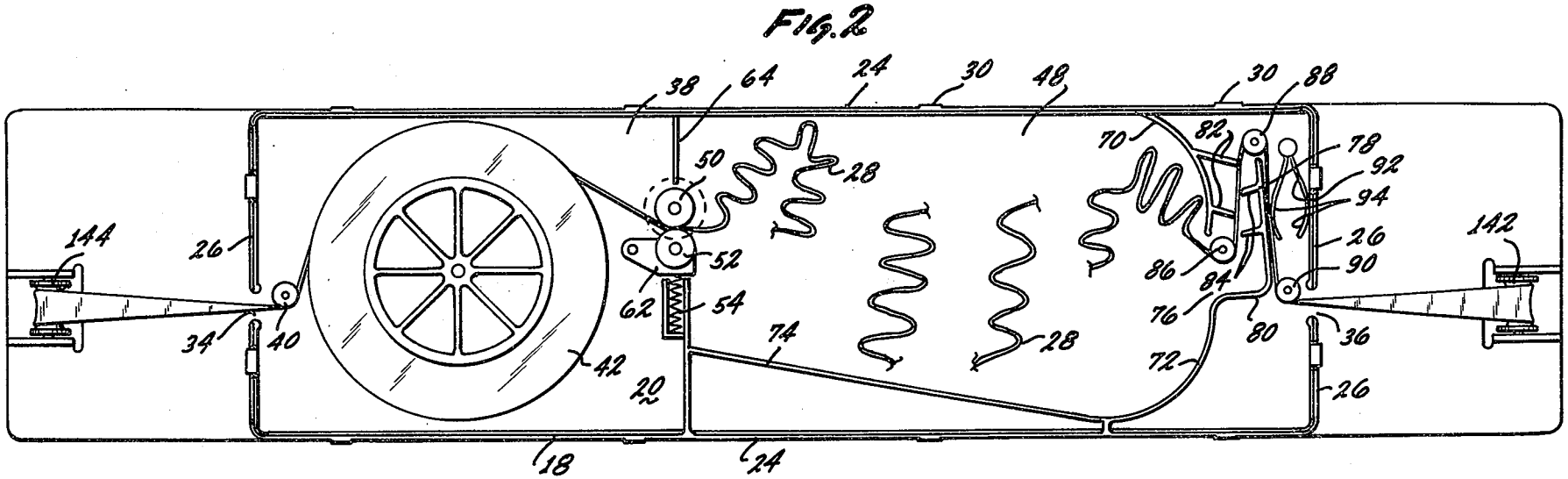
FIG. 2 is a plan or top view of a portion of the platform upon which the cassette is placed with the latter's cover removed to show the inner details thereof, and taken along line 2—2 of FIG. 1 and looking in the direction of the arrows.

Turning now to the drawings, there is shown a ribbon cassette, indicated in its entirety as 10, in position on the printer, also indicated in its entirety as 12, with a plurality of print stations, or as the case may be, an elongated platen on which a record media is transported. In this, the preferred embodiment, the printer 12 comprises a wire matrix print head 14 which traverses a plurality of print stations for printing a receipt and an audit trail or a form card and an audit trail in a point-of-sale terminal, such stations being more fully disclosed in the U.S. Pat. to Cederberg et al, No. 3,825,681, entitled "Data Terminal With Dual Three-Station Printing".

Ribbon Cassette

Turning now to FIGS. 2–5, it can be seen that the ribbon cassette 10 comprises an elongated casing 18 of any suitable material, such as polystyrene, having a planar rectangular bottom wall or base 20 (FIG. 5) and a rectangular cover comprising a planar cover wall 22

Figure 5:
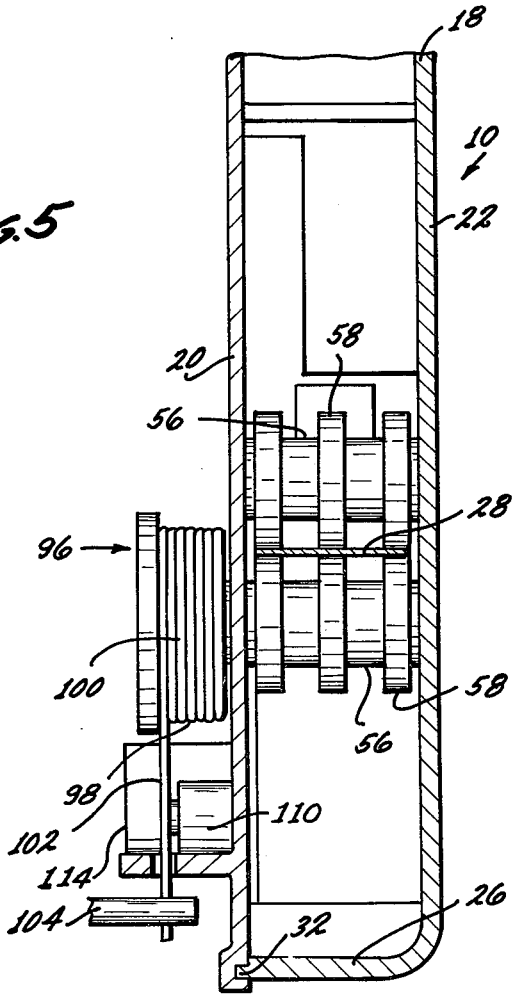
FIG. 5 is a cross-sectional view of a portion of the cassette shown in FIG. 4 taken along lines 5—5 and looking in the direction of the arrows.
Figure 6:
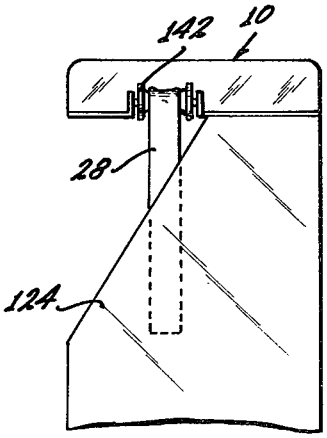

(FIG. 5) with integrally formed long side walls 24, 24 and relatively short integrally formed end walls 26, 26 to form an enclosure; said walls spacing the top wall 20 from the base 22 sufficiently to receive an ink ribbon 28 spaced edgewise vertically therebetween. Means in the form of tabs 30 are provided on the cover to snap fit into apertures in the base 20 to fasten the two pieces together in a channel 32 (FIG. 5). The ribbon 28 is a conventional cloth-type impregnated with ink, formed in a mobius loop, and disposed so as to enter the cassette through entrance opening 34 and leave the cassette from exit opening 36 on the end walls thereof.

In order to describe the operation of the invention, the following description will generally describe the cassette in terms of the travel of an increment of the ribbon through the cassette.

As the ink ribbon 28 enters the entrance opening 34 into the first chamber 38 within the cassette, it is directed around a first guide roller 40 disposed to rotate vertically or normal to the top and base of the cassette and thence partially around a rotatable, relatively large, inking roller 42, the diameter of which extends substantially the width of the chamber 38 of the cassette. The inking roller 42 is provided with a pair of peripheral flanges, one shown at 44 in FIG. 3, spaced apart to receive the ribbon and is also provided with a ring 46 of cellular type plastic material, such as polyurethane, impregnated with ink for inking the ribbon. The ring 46 is of a size only slightly less than the diameter of the inking roller so that the peripheral flanges 44 formed thereby can guide the ribbon and hold it in contact with the inking material. While the ribbon is in contact with inking material, ink is absorbed by the ribbon and the size of the roller 42 permits the ribbon to be in engagement with this inking material sufficiently long to thoroughly ink the ribbon and to allow ink migration through the threads.

Upon leaving the inking roller, the ribbon is forced into a second ribbon holding chamber 48 by a pair of ribbon moving rollers 50 and 52, one of which is spring-biased against the other by a coil spring 54 to provide sufficient tension to grip the ribbon and pull it off the inking roller and transfer it into the cavity 48.

In more detail, each roller is provided with a plurality of grooves 56 which cooperate with complementary grooves 58 formed on roller holders 60 and 62. These grooves 58 are formed to extend more than half way around the rollers so as to firmly hold the rollers in position yet permit rotation thereof, and roller 50, the driving roller, is fixedly attached to an end wall 64 which forms the separation between the inking chamber 38 and the ribbon holding cavity 48 in which the ribbon is randomly stuffed. The other holder 60, holding the driven roller 52, is pivoted at 66 and is moved by the aforementioned coil spring 54 into engagement with the inking ribbon. This spring 54 is suitably held, in the embodiment shown, in a socket 68 formed in the end wall 64.

The ribbon holding chamber 48 in which the inked ribbon 28 is forced, has a narrow portion adjacent the rollers and gradually expands to the full width of the cassette, whereupon it terminates gradually by a pair of curved walls 70 and 72. To form the narrow portion, a wall 74 extends angularly with respect to the long walls 24 and the inwardly directed curved walls 70 and 72 form an inner centrally located exit opening 76. The inner curved walls 70 and 72 overlap one another downstream of the aforesaid opening 76 by a wall extension 78 extending transverse of the cassette but spaced from wall 70 by a short wall section 80. The curved wall 70 is provided with short legs 82 extending outwardly of the cavity 48 to complement similar legs 84, offset to the legs 82, to form a labrynth through which the ribbon must pass for the purpose of removing any creases or wrinkles on the ribbon and to restrain all but a single strand as the ribbon exits the cassette. As the ribbon is exiting through the opening 76, it is directed around a first exit roller 86 and thence past the labrynth and around a second exit roller 88 so as to reverse its direction, and finally past a final exit roller 90 out exit opening 36. A spring bias in the form of spring 92 is provided to engage the ribbon as it passes from the second and third rollers 88 and 90 to provide the proper tension as the inked ribbon exits the cassette. Spring 92 is a U-shaped or hairpin-shaped spring having legs 94 under compression against walls 78 and 26.

Figure 4:
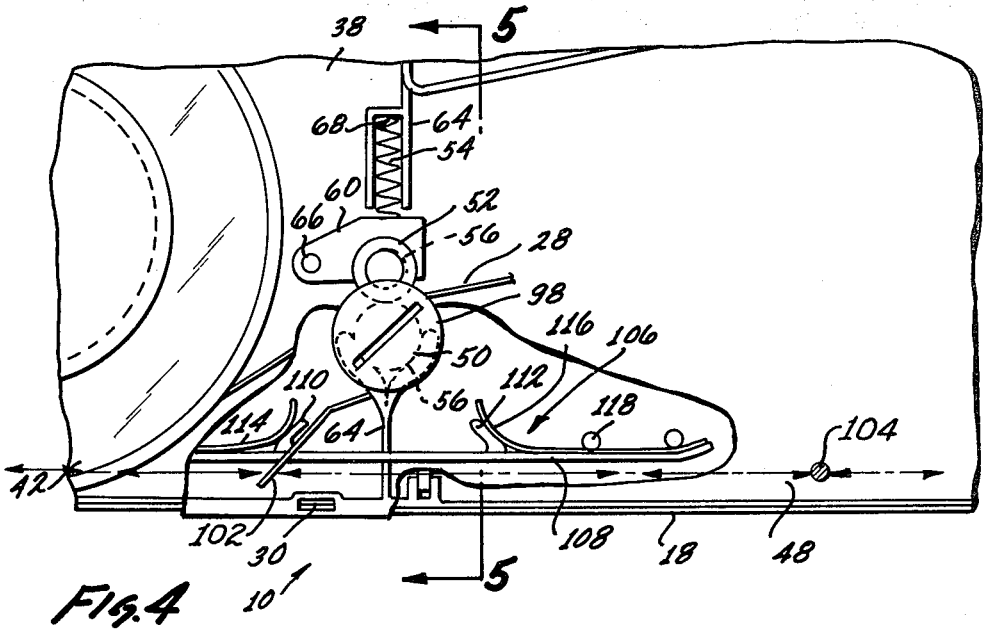
FIG. 4 is an enlarged bottom view of a portion of the cassette with parts broken away to show the inner details thereof.

Finally, attention is directed to FIGS. 4 and 5 where the ribbon advance means 96 for incrementally driving the two rollers 50 and 52 is shown. This driving means comprises clutch drum 98 formed on, or integral with, the stationary roller 50 which extends downwardly or outwardly from base 20 and is encompassed by a coil spring 100 forming therewith a one-way clutch which is actuated by the end or leg forming a latch arm 102 of the coil spring engaging a mechanism shown as a pin 104 which will cause it to move. Since such one-way clutches are well-known, suffice to say that movement of the latch arm 102 in one direction causes winding and tightening of the coil around the drum, whereas movement in the other direction allows the coil to unwind and to move freely of the drum. Movement of the drum, of course, in turn, increments the drive roller 50 so as to rotate roller 52 and move the ribbon toward the cavity 48.

Since the position of the leg 102 of the one-way clutch is important in that it must be engaged by an engaging mechanism 104 to increment the ribbon, a positioning device, indicated in its entirety as 106, is provided on the base 20 integrally therewith and extending in the direction of the drum. This positioning device comprises a wall 108 with a slight curvature at each end and with two tabs 110, 112 extending in the direction of the drum, which are engaged by a pair of slightly curved leaf springs 114, 116; the latter being held in their respective places by stubs or pins 118 adjacent the wall (only two shown). These leaf springs are positioned so that their respective curved portions are face-to-face but spaced from one another to be engaged as the leg 102 is moved by the engaging mechanism 104. That is to say, the throw, or traverse, of the leg 102 is between two extremes defined by the space between the two leaf springs which, when engaged, tend to also resiliently urge the leg 102 back and away, i.e., outwardly of the cassette, such as shown in FIG. 4, so that engagement by the engaging mechanism is assured.

Thus, as the engaging mechanism engages the leg 102 in one direction, it throws the leg against the spring 114 which, at the same time as it is being thrown, the clutch coil 100 tightened on the drum, causing it to rotate one increment. On the return trip of the engaging mechanism, the leg 102 is thrown in the opposite direction against the spring 116, while at the same time, the coil 100 is unwound and rotated about the drum without moving the drum.

Cassette and Printer

Turning now back to FIG. 1 where the cassette 10 is placed on the printer 12, which is preferably a POS terminal, with the wire matrix print head 14 utilizing the ribbon 28.

In this embodiment, the POS terminal comprises, in the parts shown, a form station, an audit trail station, and a receipt station; all of which functionally form a platen for the printing of characters on record media at these stations. In the actual embodiment, as is customary in the operation of POS terminals, the print head will traverse either of two pairs of stations, the audit trail station and the form station, or the audit trail station and the receipt station, depending upon the transaction involved. That is to say, if the transaction involves a form, such as a bill of sale, or involves credit with a computer card, the print head will print at the form station and the audit trail station so that a record is kept on the audit trail of what was printed at the form station. Similarly, if it is a cash transaction and a cash register receipt is to be available, the print head will print on the audit trail and at the receipt station so that a record will be kept of what was printed at the receipt station, which receipt is normally severed and may be handed to the customer.

In order to accomplish this traverse of the print head 14, in the embodiment shown, the print head is mounted for movement on a pair of transverse parallel shafts 120 and 122 suitably fixed on a pair of vertical end plates 124 and 126 and connected for movement by a traverse wire 128. Traverse wire 128 is an endless loop type wire with both ends connected to the print head and disposed about a first pulley 130 and finally, around a pair of pulleys 132 and 134 which, in turn, are mounted on a rotatable shaft 136. Rotatable shaft 136 is positioned by a shaft-position encoder 138 which is responsive to a keyboard and keyboard electronics (not shown) forming part of the POS terminal. The electronics for operating the matrix print head is introduced into the print head through a cable 140 which, of course, is connected to the aforementioned electronics.

Spaced horizontally at the top of the two end plates 124 and 126 is a relatively flat horizontally disposed platform 140 sufficiently large to support the cassette 10 and to space a pair of horizontally disposed pulleys 142 and 144 therefrom a suitable distance to permit the ink ribbon 28, being a mobius loop, to twist as it enters and leaves the cassette without interference to the cassette entrance 34 and exit 36 for the proper operation of the working parts therein and as above described.

Further, in the embodiment shown, the ink ribbon 28 being a continuous loop, after leaving the exit 36, is directed over pulley 142 and downwardly and around a second pulley 146 located approximately at the level of entrance pulley 148 located on the print head 14. The print head is provided with a pair of pulleys 150 which direct the ribbon between the ends of the wires of the matrix print head and between the record media. Then the ribbon is directed back around another set of pulleys 152 and 154 similar to those previously described and finally around pulley 144 where the used inked ribbon is returned to the cassette.

In this embodiment it should be clear that while the print head 14 traverses the three stations as indicated in the dotted line positions 156 and 158, the ink ribbon is under the control of the driving rollers 50 and 52 within the cassette so that the ribbon is held relatively stationary, except for the increments of movement thereof that are introduced by the action of the engaging mechanism 104 contacting the ribbon drive means 96. In other words, the print head is free to traverse the relatively stationary ribbon.

It should also be clear from the above description that the engaging mechanism 104, to actuate the ribbon drive means, is located at the top of the print head 14 and since the print head always traverses the audit trail station, whether printing on the audit trail and the receipt station, or on the audit trail and the form station, the engaging mechanism 104 is always in a position to engage the ribbon drive means 96 since the latter is centrally located with respect to the cassette and with respect to the platform 104.

Figure 3:
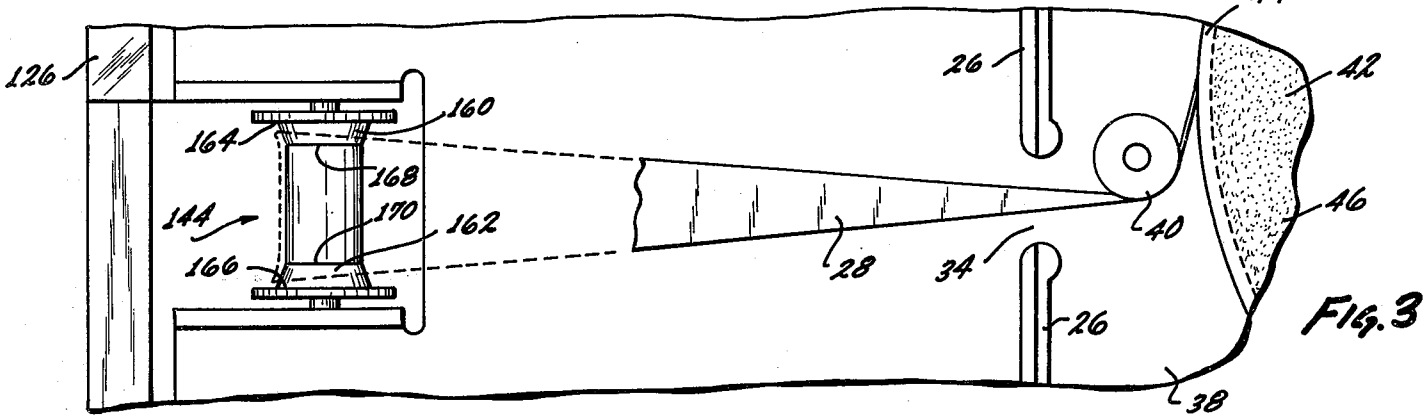
FIG. 3 is an enlarged view of a portion of FIG. 2 to show the guide means of the ribbon to the cassette and a small portion of the cassette in more detail.

Another feature of the present invention has been incorporated in the pulleys for handling the ink ribbon, which feature is more clearly shown in the enlarged drawing of FIG. 3. As clearly shown in this figure, the pulley 144 is disposed to rotate horizontally, thus permitting the ribbon to twist as it enters the entrance 34 to the cassette, and is suitably spaced therefrom to prevent any hindrance to the internal workings of the cassette as mentioned heretofore. It has been found, however, that for the proper operation of the pulleys, such as 144, the pulley is provided with guide ramps or tapers 160 and 162 located on each end and disposed so that their outward edges 164, 166 have the greatest radius with respect to the axis of the pulley and also disposed so that the inner edges 168, 170 are within the outer edges of the ribbon at all times, so as to engage and distort the outer edge of the ribbon as shown. It has been found that with these outer guide rings, the ribbon is better guided in the pulleys than in the prior art devices where the tapered surface is located centrally of the pulley so as to engage the center line of the ribbon. All of the pulleys in this invention are provided with these guide ramps; the pulley shown in FIG. 3 being only illustrative of these features.

From the foregoing it can be seen that there is provided an ink ribbon cassette which includes a means of inking the ribbon within the cassette as well as a place to store a large amount of ribbon for use by a printing device, such as the one disclosed herein. It is also important to note that the ribbon is easily replaced without misalignment, since there are no positive engaging mechanisms to be dealt with, the driving mechanism 96 being free of the engaging mechanism 104 except, of course, when it is used to move the driving mechanism by the operation of the print head.

What is claimed is:

1. An ink ribbon cassette for a printer having a print head which travels in a first direction and in a second direction opposite to said first direction over a record media for printing alphanumeric characters thereon comprising:

a housing having an entrance and an exit;

an inking ribbon in the form of a mobius loop having at least a portion of its length located within said housing and entering therein by way of said entrance and leaving therefrom by way of said exit;

a first chamber in said housing containing a portion of said ribbon and into which said entrance opens;

inking means in said first chamber contacting at least a portion of the ribbon located in said first chamber to transfer ink thereto;

a second chamber in said housing for the storage of inked ribbon therein and including said exit;

ribbon driving means located between said first chamber and said second chamber for transporting said ribbon from said first chamber and stuffing the same in random convolutions in the second chamber;

one way clutch coupled to said ribbon driving means and having a latch arm extending therefrom into the path of travel of said print head; and means on said print head for alternately engaging said latch arm of said one way clutch during at least a portion of the travel of said printhead to move said latch arm in said first direction and then in said second direction opposite to said first direction to actuate said ribbon driving means during movement of said latch arm in one of said directions to thereby increment said ribbon in and out of said cassette as said printer traverses said record media.

2. The cassette as claimed in claim 1 further including a labrynth opening in said second chamber and opening into said exit for removing any creases or wrinkles in said ribbon and to insure that one strand of said ribbon exits at a time.

3. The cassette as claimed in claim 1 wherein said inking means comprises a roller having ink holding material thereon for contacting said ribbon as the latter is moved by said ribbon driving means from said first chamber to said second chamber, said roller being rotated by engagement with said moving ribbon.

4. The cassette as claimed in claim 3 wherein said driving means comprises a pair of rollers resiliently biased to engage said inked ribbon, one of said rollers having said one-way clutch connected thereto to rotate said rollers upon engagement of said latching arm by said means on said print head when moving in one of said directions.

5. The cassette as claimed in claim 1 wherein said cassette further includes resilient means for positioning said latch arm for engagement by said means on said print head.

* * * * *